United States Patent [19]

Bauerschmidt

[11] 4,136,757

[45] Jan. 30, 1979

[54] ABSORPTION MUFFLER CONSTRUCTION

[75] Inventor: Walter Bauerschmidt, Kirchheim-Otlingen, Germany

[73] Assignee: J. Eberspächer, Germany

[21] Appl. No.: 856,987

[22] Filed: Dec. 2, 1977

[30] Foreign Application Priority Data

Apr. 4, 1977 [DE] Fed. Rep. of Germany ..... 2715053

[51] Int. Cl.[2] ..... F01N 1/10; F01N 1/12

[52] U.S. Cl. ..... 181/256; 181/267; 181/279

[58] Field of Search ..... 181/238, 279, 280, 256, 181/257, 274, 267, 268, 281, 282, 232, 239

[56] References Cited

U.S. PATENT DOCUMENTS

| | | | |
|---|---|---|---|
| 3,066,755 | 12/1962 | Diehl | 181/279 |
| 3,927,731 | 12/1975 | Lancaster | 181/256 |

FOREIGN PATENT DOCUMENTS

| | | | |
|---|---|---|---|
| 614930 | 2/1936 | Fed. Rep. of Germany | 181/279 |
| 634222 | 8/1936 | Fed. Rep. of Germany | 181/279 |
| 1174509 | 11/1958 | France | 181/279 |
| 869236 | 5/1961 | United Kingdom | 181/279 |

*Primary Examiner*—Stephen J. Tomsky
*Attorney, Agent, or Firm*—McGlew and Tuttle

[57] ABSTRACT

An absorption muffler for flowing gases and particularly for exhaust gases from internal combustion engines comprises a housing which is of oblong shape and has spaced apart semicylindrical short side walls, with long side walls on each side which are synclinally drawn in the middle thereof. Parallel inlet and outlet pipes are connected into the front wall and extend substantially up to the rear wall, and they are located in substantially parallel relationship centered within the respective short side wall semicylindrical portions. An inlet channel is defined on the interior of the housing which extends in a helical curve around the inlet pipe, which in one embodiment has a single convolution and in another embodiment has a plurality of convolutions. This inlet channel connects to a similarly constructed outlet channel designed around the outlet pipe through an obliquely extending connecting channel. The inlet channel comprises either a single convolution or a plurality of convolutions. Both the inlet and the outlet pipes are enveloped with a spacing by a surrounding wall, which has an unperforated surrounding wall portion which overlies a perforated portion of the respective inlet or outlet. Sound damping material is provided along the length of the inlet and the outlet channels and the connecting channel, and fills the wall space between adjacent convolutions of the inlet and outlet channels and the space between either one of the convolutions and the wall of the chamber, and between the connecting channel and the wall of the housing.

16 Claims, 10 Drawing Figures

50
1a
13
23
24
11a
9
11
D
2a
C
2c
24c
2a
12
11b
14
4
8
10
12a
1b
12b
7
3
2b 50
24a
4
23a
5
3
5b
24d
25
A
B
12
8
7
24 d
11
6b
6
23b
24b

ABSORPTION MUFFLER CONSTRUCTION

BACKGROUND OF THE INVENTION

1. Field of the Invention

This invention relates in general to the construction of mufflers and particularly to a new and useful absorption muffler, particularly for exhaust gases from internal combustion engines.

2. Reference to Other Application

This invention is an improvement over that disclosed and claimed in pending U.S. application Ser. No. 778,474.

DESCRIPTION OF THE PRIOR ART

In view of its size and shape a known device is unsuitable for assembly in vehicles; for it has a housing of circular section, therefore requires a great assembly height which is usually not available. This is also the reason why the number of helically extending channels and thus the muffling effect must remain limited. Also unfavorable is the outlet nipple which is attached on the side of the housing and must first be bent to be able to connect an exhaust gas pipe which normally runs parallel to the housing axis; this device is therefore structurally expensive also. Moreover, nothing is said on how the housing and the channel walls are constructed and interconnected.

It is known through the German Pat. No. 614,930 to provide a muffler with flat housing section and semicylindrical short sidewalls and one freely entering coaxial entry and exit nipple to which one channel part each with helically wound walls is connected. These walls have openings for the passage of gas which bring about parallel flows of different lengths and are obviously intended for interference effect. By contrast, absorption effect is not intended since no sound absorbing material is used. No indication is made on the construction of housing and channel walls and how they are connected.

SUMMARY OF THE INVENTION

The invention provides an absorption muffler with little space requirement and particularly small height requirement of its sound suppressor, thereby creating favorable conditions and connecting possibilities for the inlet and outlet pipe with respect to assembly in vehicles. The occurring flow losses and thus the motor counter pressure are kept low, and the design according to the invention is suited for economical mass production.

In accordance with the invention a particularly flat housing section for the muffler is possible because a roughly helical channel part through which a medium can flow from the inside to the outside is juxtaposed to one in which the medium can flow from the outside to the inside. The coaxial inlet or outlet nipple attached to each runs parallel to the housing axis which is favorable for assembly in vehicles. In addition, the intermediate space including sound absorption filler is utilized best by the connecting channel arrangement oblique to the housing section. This is also favored by the synclinally drawn-in long sidewalls, which also provide excellent stiffening for housing and jacket. The occurring flow losses and hence the motor counterpressure are low due to the favorable channel arrangement. As the channels have sound absorbing walls throughout, the sound attenuation is surprisingly great considering the small size of the device.

This applies even more to a muffler of the invention which contains in each channel part an additional helical coil. This construction insures that, despite an only moderate increase in housing height, a considerable extension of the sound-damped flow travel distance is achieved. The channel walls are constructed very simply, thus making them readily producible in practice.

Accordingly, it is an object of the invention to provide an absorption muffler for flowing gases, particularly for exhaust gases from internal combustion engines, which comprises a housing which has spaced-apart semicylindrical short side walls and long side walls which are longer than said short side walls which have centrally inwardly drawn synclinally formed portions between the semicylindrical portions, and a front wall into which spaced apart inlet and outlet pipes extend substantially up to the rear wall, and which each include perforations on a portion of their circumference and which are enveloped on the interior of the housing by an inlet channel which has one or more spiral convolutions and which extends from the area of the inlet pipe obliquely through a connecting channel to an outlet channel enveloping the outlet pipe and having one or more spiral convolutions, and wherein the walls of the channels are covered with a sound damping material wherein the portion overlying the inlet and outlet pipes is perforated except in the area of the perforations of the inlet and outlet channels.

A further object of the invention is to provide an absorption muffler for flowing gases which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1A:
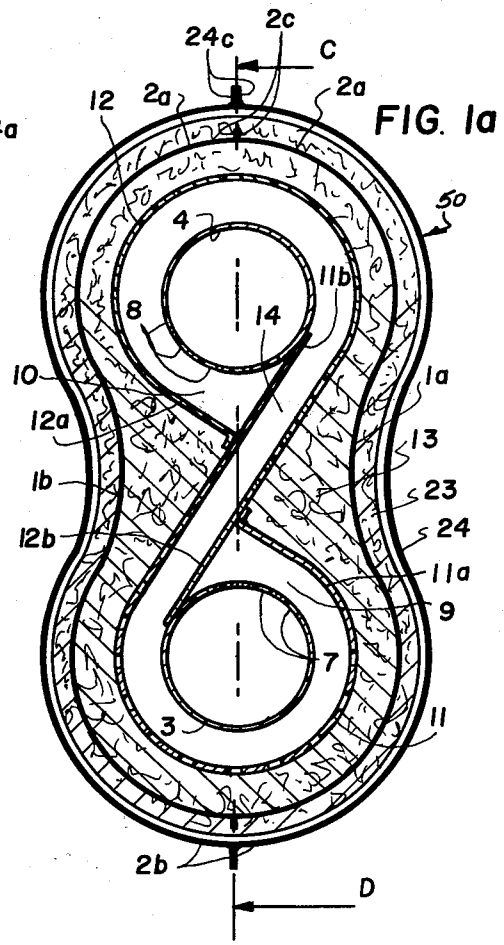
FIG. 1*a* is a section taken along the line A–B of FIG. 1.
Figure 1:
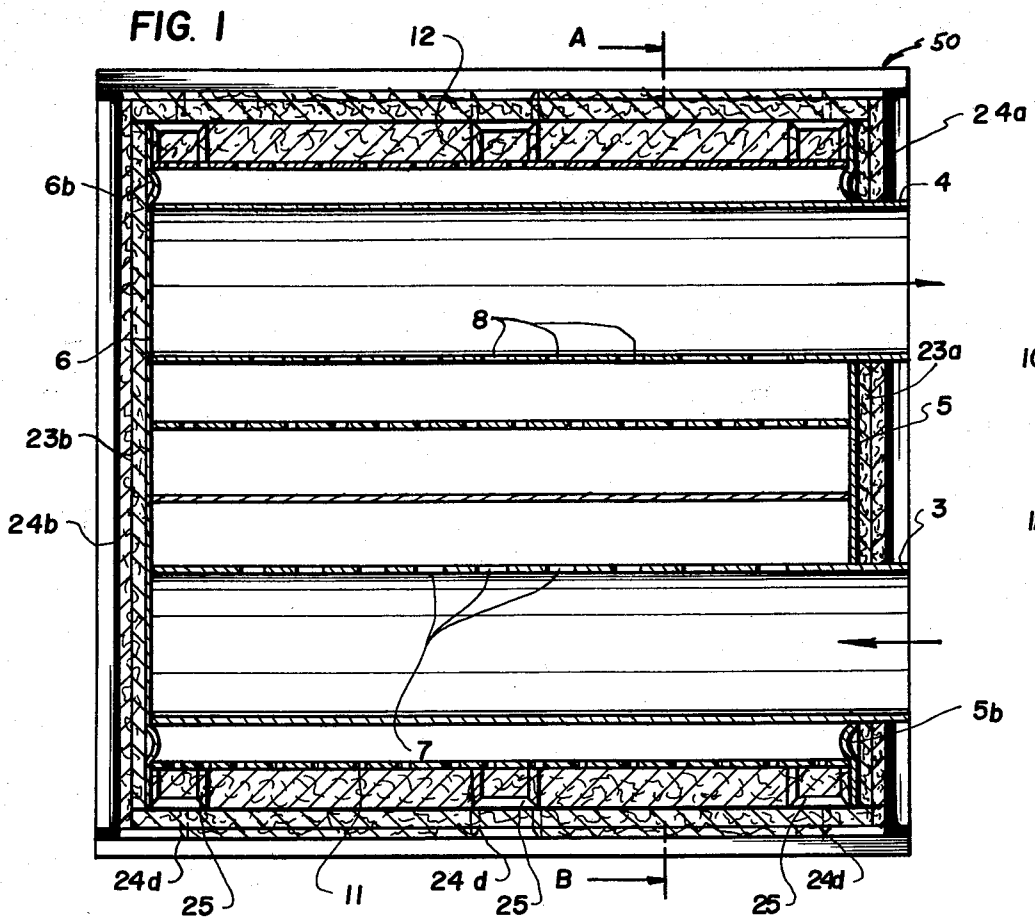
FIG. 1 is a sectional view taken along the line C–D of FIG. 2 of an exhaust gas muffler constructed in accordance with the invention.
Figure 1B:
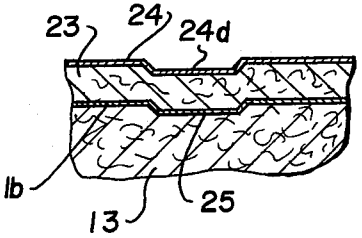
FIG. 1*b* is a partial sectional view of a portion of the wall of the muffler shown in FIG. 1.
Figure 1C:
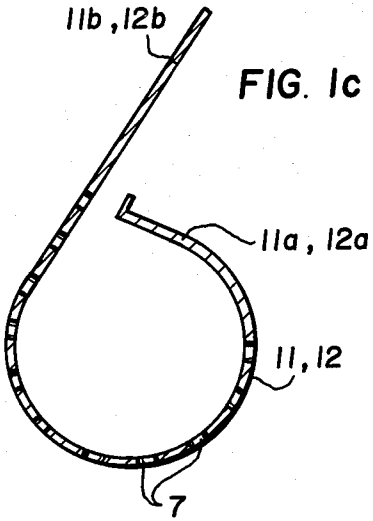
FIG. 1*c* is a section of a wall of the interior of the muffler housing shown in FIG. 1*a;*

Referring to the drawings in particular and the embodiments of FIGS. 1–1*c* there is provided an exhaust gas muffler generally designated 50 which includes a housing of oblong configuration which has short side walls 2*a* and 2*b* which are spaced apart by intermediate inwardly extending wave shaped walls defined along sides which are longer than the short sides 2a and 2b. Respective substantially parallel spaced apart inlet and outlet pipes 3 and 4 are concentrically arranged in respect to the short side walls 2a and 2b, and they include perforations over a part of their periphery. The inlet pipe 3 is enveloped by a means defining an inlet channel 9 which has a single or a multiple number of helically formed convolutions which connect with a similarly formed outlet channel 10 defined around the outlet tube 4 and the two channels are interconnected by a connecting channel 14 which extends obliquely from the inlet channel to the outlet channel across the interior of the central portion of the housing.

According to FIGS. 1, 1a and 2, 2a, respectively, the muffler housing is formed by two semicylindrical short walls 2a and 2b of flat cross section, and by two long side walls which connect the former and are drawn in synclinally in the middle. Fastened to a face 5 coaxial to each semicylinder is an inlet nipple 3 and outlet nipple 4, respectively, which extend to the opposite face 6. In a part of their circumference these nipples have a perforation 7 and 8, respectively, covered by an unperforated portion 11a, 12a of a perforated wall 11, 12, respectively, which is fastened to the nipple. These walls extend from one face to the other and enclose the nipples with spacing.

In the first embodiment example of FIG. 1, these perforated walls 11 and 12 which form roughly helical channels 9 and 10, respectively, are embedded in a sound absorbing filling 13 of the housing, the cross section of which they penetrate obliquely; their other, unperforated end portion 11b and 12b, respectively, is in close contact with the respective other nipple 4 and 3 and with the unperforated wall end section 12a and 11a, respectively, which encloses the nipple. Thus an oblique, sound-damped connecting channel 14 of the helical channels 9 and 10 is formed which are at the same time closed off at one side.

Figure 2A:
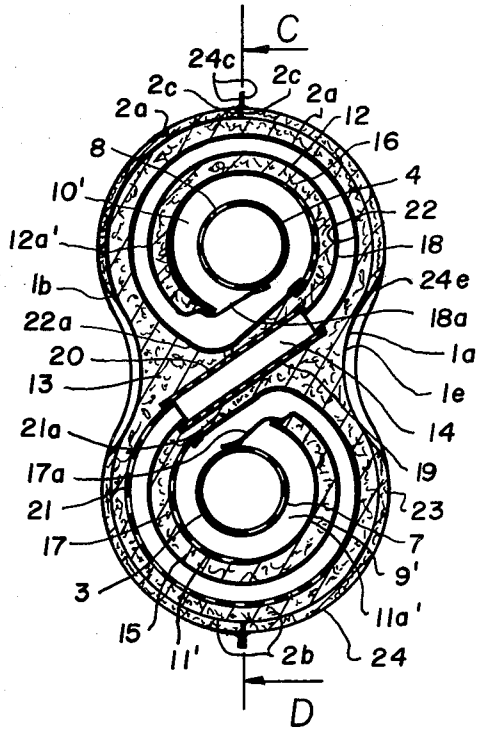
FIG. 2*a* is a section taken along the line 2*a*—2*a* of FIG. 2.
Figure 2:
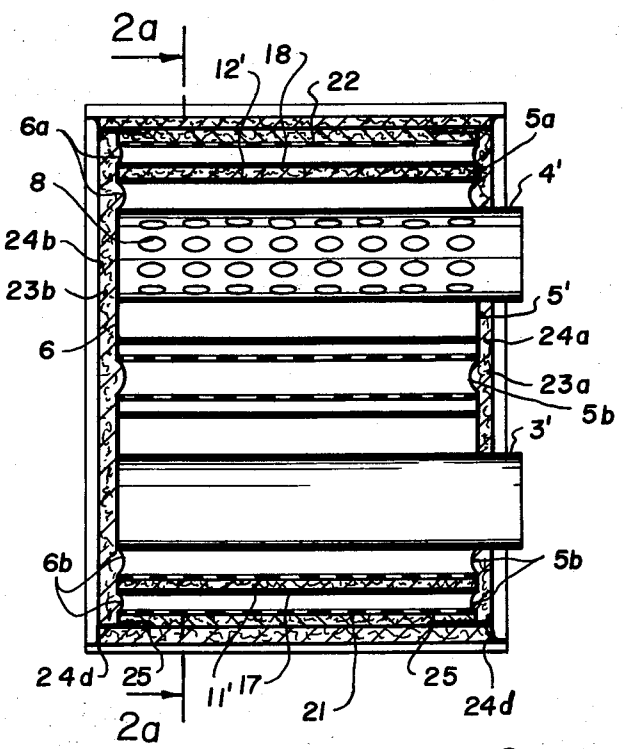
FIG. 2 is a view similar to FIG. 1 of another embodiment of the invention.
Figure 2E:
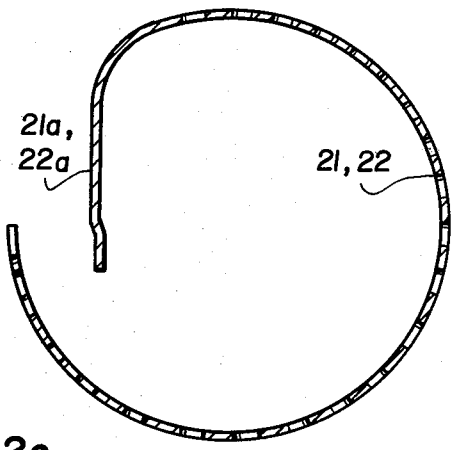
FIGS. 2*c*, 2*d* and 2*e* are sectional views of inserted channel walls in transverse section.

In the second embodiment of FIG. 2 the perforated walls 11' and 12' including their unperforated end section 11a' and 12a' respectively are enveloped by an unperforated wall 17, 18, respectively, with the interposition of a layer 15, 16, respectively, of sound absorbing material. One end 17a, 18a, respectively, of the respective walls 17 and 18 are drawn inwardly to close off one side of channels 9' and 10', respectively, and it makes close contact with respective nipples 3' and 4', and is connected via a perforated wall 19, 20, respectively, which penetrates the housing cross section obliquely within a filling 13 of sound absorbing material, to a perforated wall 22, 21, respectively which envelops with spacing the unperforated wall 18, 17, respectively, of the respective other helical channel 10', 9' while making close contact with the inner, unperforated wall 12', 11', respectively at an unperforated end section 22a, 21a, respectively. Thus an oblique, sound-damping connecting channel 14 of the helical channels 9 and 10 is formed.

Inlet nipple 3 and outlet nipple 4 on the one hand, and the channel walls 11' and 12' — according to FIG. 2 also the channel walls 17, 18 and 21, 22 and 19, 20 respectively — on the other are shown to be identical in both embodiment examples so that they are mutually interchangeable and result in mutually identical channels 9, 10. As a matter of course, they may also be of different design, for instance, to take into account the progressing relief of the exhaust gases. Therefore, the channels need not be of constant height as shown either. Nor is the constant height of the enveloping filling of sound absorbing material or constant thickness of the layer of sound absorbing material an absolute necessity.

In order to fix the channel walls in radial and in circumferential directions during the assembly until connected by welding, the housing faces 5 and 6 have inwardly oriented depressions 5b and 6b, respectively, along the channels 9, 10, and 14 to seat the walls.

Figure 2B:
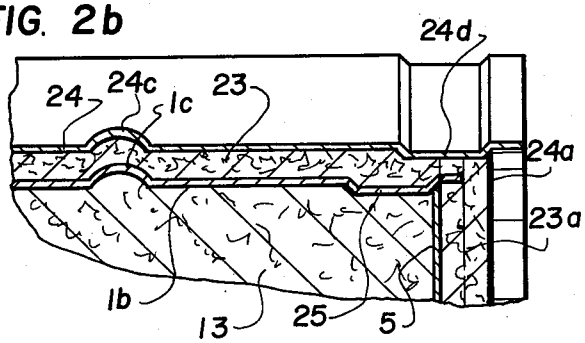
FIG. 2*b* is a partial section of the wall of the muffler shown in FIG. 2.
Figure 2D:
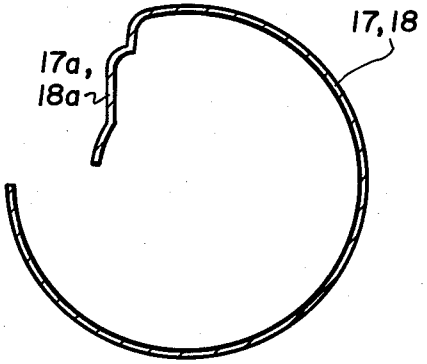
Figure 2C:
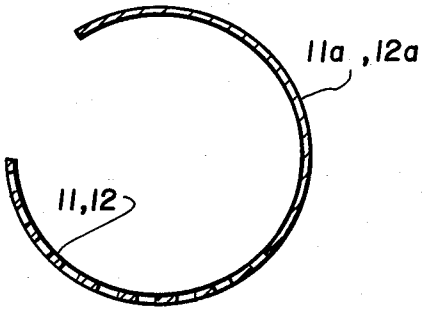

In the embodiment examples, the housing is also shown advantageously in FIG. 1b and FIG. 2b sheathed in a heat shield 23, 23a, 23b of uniform thickness and covered by a light, not load-bearing jacket 24, 24a, 24b. For reinforcement, transverse corrugations 24e and 1e, respectively, are provided on the synclinal depression of the jacket 24 and on the long housing sides 1a, 1b (FIG. 2a). The same purpose is served by corrugations 25 extending transversely along the housing circumference, primarily along the lateral edges. Advantageously, identically shaped edge corrugations 24d of the jacket make lateral contact with its cup-shaped faces 24a, 24b.

To facilitate assembly, housing and jacket are split like bowls in their meridian long plane of symmetry C–D according to the embodiment example shown in FIG. 2 and connected through edge flanges 2c and 24c, respectively, located in this plane.

The connection of channel walls, housing and jacket parts is produced by welding throughout. Points not accessible from the outside are made accessible for welding by elongated holes 5a, 6a, in the faces 5 and 6.

While specific embodiments of the invention have been shown and described in detail to illustrate the application of the principles of the invention, it will be understood that the invention may be embodied otherwise without departing from such principles.

What is claimed is:

1. An absorption muffler for flowing gases, particularly exhaust gases from internal combustion engines, comprising an oblong housing having spaced apart semicylindrical short side walls, long side walls longer than said short side walls on each side having intermediate synclinally drawn portions therebetween on each side, a rear wall and a front wall, an inlet pipe and an outlet pipe arranged in spaced parallel relationship and centered within the respective short side walls and extending into said front wall of said housing substantially up to said rear wall, and each having a circumferential portion with perforations and a remaining unperforated portion, inlet means defining an inlet channel connected to the perforated circumferential portion of said inlet pipe and extending in at least one helical curve around said inlet pipe, means defining an outlet channel connected to the perforated circumferential portion of said outlet pipe and extending in a helical curve around said outlet pipe, both said outlet pipe and said inlet pipe being enveloped with and spaced from a surrounding wall of the respective inlet channel and outlet channel and having an unperforated surrounding wall portion overlying the respective perforated portion of the associated inlet pipe and said outlet pipe and a perforated portion which extends around the associated outlet and inlet pipe and then obliquely between said inlet and outlet channels to define connecting channels between said outlet and inlet channels, a sound damping material covering each convolution of said helical curve of portion of said inlet and outlet channels and also covering said connecting channels on the interior of said housing.

2. An absorption muffler according to claim 1, wherein said inlet means defining an inlet channel includes a single curve around the associated inlet pipe and said outlet means defining said outlet channel defines a single curve around said outlet pipe.

3. An absorption muffler according to claim 1, wherein there are a plurality of convolutions defined around said inlet and said outlet pipes by said inlet and outlet means respectively.

4. An absorption muffler according to claim 1, wherein said inlet and outlet pipes are of identical design.

5. An absorption muffler according to claim 1, wherein said inlet and outlet pipes and said means defining said inlet channel and said means defining said outlet channel are identical in design.

6. An absorption muffler according to claim 1, wherein the sound absorption material layers between said inlet and outlet channels and the respective short side walls and the sound absorbing material between the successive convolutions of channel walls are of uniform thickness.

7. An absorption muffler according to claim 1, wherein said inlet and outlet channels are of uniform height.

8. An absorption muffler according to claim 1, wherein said front and rear walls have inwardly directed indentations, said inlet channel and outlet channel having walls which contact said indentations.

9. An absorption muffler according to claim 1, including a jacket surrounding said housing and a heat shield between said jacket and said housing.

10. An absorption muffler according to claim 9, including corrugations defined between said jacket and said housing.

11. An absorption muffler according to claim 9, wherein said jacket has faces of cup-shaped configurations, said jacket having wall corrugations in contact with said housing.

12. An absorption muffler according to claim 9, wherein there are corrugation elements defined around the periphery of said housing, short and long side walls, each front and rear wall being in contact with a corrugation.

13. An absorption muffler according to claim 1, including an outer jacket wall spaced from said housing wall around said short and long side walls, and including a member defining a corrugation between said jacket and said housing on said long sides of said housing in said synclinal portions thereof.

14. An absorption muffler according to claim 1, wherein said housing is split along a longitudinal center line into first and second bowl portions.

15. An absorption muffler according to claim 1, wherein connecting parts of said outlet and inlet channels and said connecting channel are welded.

16. An absorption muffler according to claim 1, wherein each front and rear wall of said housing has oblong holes therein for facilitating welding of the interior parts thereof.

* * * * *